US007966797B2

(12) United States Patent
Nguyen et al.

(10) Patent No.: US 7,966,797 B2
(45) **Date of Patent: *Jun. 28, 2011**

(54) METHOD OF MAKING MONOFILAMENT FISHING LINES OF HIGH TENACITY POLYOLEFIN FIBERS

(75) Inventors: Huy X. Nguyen, Midlothian, VA (US); Thomas Y-T. Tam, Chesterfield, VA (US); Brian H. Waring, Chester, VA (US)

(73) Assignee: Honeywell International Inc., Morristown, NJ (US)

( * ) Notice: Subject to any disclaimer, the term of this patent is extended or adjusted under 35 U.S.C. 154(b) by 192 days.

This patent is subject to a terminal disclaimer.

(21) Appl. No.: 12/215,135

(22) Filed: Jun. 25, 2008

(65) Prior Publication Data

US 2009/0321976 A1 Dec. 31, 2009

(51) Int. Cl.
*D01H 13/30* (2006.01)

(52) U.S. Cl. ..... 57/292

(58) Field of Classification Search ..... 57/236, 57/241, 243, 250, 292

See application file for complete search history.

(56) References Cited

U.S. PATENT DOCUMENTS

| | | | | |
|---|---|---|---|---|
| 4,137,394 | A | 1/1979 | Meihuizen et al. | 528/100 |
| 4,356,138 | A | 10/1982 | Kavesh et al. | 264/164 |
| 4,413,110 | A | 11/1983 | Kavesh et al. | 526/348.1 |
| 4,430,383 | A | 2/1984 | Smith et al. | 428/364 |
| 4,436,689 | A | 3/1984 | Smith et al. | 264/204 |
| 4,457,985 | A | 7/1984 | Harpell et al. | 428/224 |
| 4,536,536 | A | 8/1985 | Kavesh et al. | 524/462 |
| 4,545,950 | A | 10/1985 | Motooka et al. | 264/210.6 |
| 4,551,296 | A | 11/1985 | Kavesh et al. | 264/203 |
| 4,612,148 | A | 9/1986 | Motooka et al. | 264/49 |
| 4,617,233 | A | 10/1986 | Ohta et al. | 428/364 |
| 4,663,101 | A | 5/1987 | Kavesh et al. | 264/178 F |
| 5,032,338 | A | 7/1991 | Weedon et al. | 264/203 |
| 5,207,732 | A * | 5/1993 | Stark | 43/44.98 |
| 5,246,657 | A | 9/1993 | Yagi et al. | 264/210.6 |
| 5,286,435 | A | 2/1994 | Slukster et al. | 264/205 |
| 5,342,567 | A | 8/1994 | Chen et al. | 264/203 |
| 5,573,850 | A | 11/1996 | Cunningham et al. | 428/373 |
| 5,578,374 | A | 11/1996 | Dunbar et al. | 428/364 |
| 5,702,657 | A | 12/1997 | Yoshida et al. | 264/112 |
| 5,736,244 | A | 4/1998 | Kavesh et al. | 428/364 |
| 5,741,451 | A | 4/1998 | Dunbar et al. | 264/103 |
| 5,958,582 | A | 9/1999 | Dunbar et al. | 428/364 |
| 5,972,498 | A | 10/1999 | Kavesh et al. | 428/364 |
| 6,148,597 | A | 11/2000 | Cook | 57/287 |
| 6,448,359 | B1 | 9/2002 | Kavesh | 526/352 |
| 6,969,553 | B1 | 11/2005 | Tam et al. | 428/364 |
| 7,344,668 | B2 | 3/2008 | Tam et al. | 264/210.8 |
| 7,370,395 | B2 | 5/2008 | Tam | 28/246 |
| 2009/0324949 | A1 * | 12/2009 | Nguyen et al. | 428/373 |

FOREIGN PATENT DOCUMENTS

| | | | |
|---|---|---|---|
| JP | 05009879 | A | 1/1993 |
| JP | 06200207 | A | 7/1994 |
| JP | 2006132006 | A | 5/2006 |
| WO | 2004082466 | A2 | 8/2004 |
| WO | WO2006/040191 | | 4/2006 |

* cited by examiner

*Primary Examiner* — Shaun R Hurley

(57) ABSTRACT

A method of making colored monofilament ultrahigh molecular weight polyolefin fishing line, comprising the steps of feeding a substantially untwisted multifilament ultrahigh molecular weight polyolefin yarn; coating the substantially untwisted multifilament yarn with a colorant; twisting the coated multifilament yarn; and heating the twisted multifilament yarn to a temperature and for a time sufficient to at least partially fuse adjacent filaments together while stretching the yarn. The resultant product is a colored monofilament fishing line that has improved color-fastness and abrasion resistance.

21 Claims, No Drawings

METHOD OF MAKING MONOFILAMENT FISHING LINES OF HIGH TENACITY POLYOLEFIN FIBERS

BACKGROUND OF THE INVENTION

1. Field of the Invention

This invention relates to improvements in fishing lines formed from high tenacity polyolefin fibers.

2. Description of the Related Art

Fishing lines formed from high tenacity polyolefin fibers are known. Such fibers may be high tenacity polyethylene fibers, such as SPECTRA® extended chain polyethylene fibers and yarns from Honeywell International Inc., as well as other suppliers. Such fishing lines have been commercially successful.

Typically, such high tenacity fibers are made by a spinning a solution containing polyethylene gel swelled with a suitable solvent into filaments of ultrahigh molecular weight polyethylene. The solvent is removed and the resulting yarn is stretched or drawn in one or more stages. In general, such filaments are known as "gel spun" polyolefins, with gel spun polyethylene being the most commercially sold.

Fishing lines from gel spun polyethylene yarns are typically made by braiding multifilament yarns. These fishing lines have advantages over other braided fishing line materials (such as polyesters) as well as nylon monofilament lines, as the ultrahigh molecular weight polyethylene lines have higher strength. However, many anglers prefer the feel of a monofilament fishing line, and braided lines may fray at the end of the line. Also, braided polyethylene lines need to be cut with a shearing device such as a scissor rather than the commonly used compression type line clipper.

It has been proposed in U.S. Pat. No. 6,148,597 to provide polyolefin fishing line that is more monofilament-like in handling. This patent suggests forming braided or twisted yarns and then heating the yarns so that they fuse together. Certain coating materials are suggested to aid in the fusing of the multifilament yarns. The yarns are also subject to a drawing step, with draw ratios of between 1.01 and 2.5 being disclosed.

An improvement on the above technique is described in WO 2006/040191 A1, wherein multifilament yarns are drawn at a ratio of at least 2.7. The result is said to be a fishing line having improved properties such as higher elongation at break.

Fishing lines which are colored are preferred by many anglers. Heretofore, this has been achieved by introducing the braided or twisted yarn into a coating bath containing a colorant. However, it has been found that the colored coating tends to come off with vigorous rubbing. It would be desirable to provide a monofilament polyolefin fishing line that had improved color fastness.

SUMMARY OF THE INVENTION

In accordance with this invention, there is provided a method of making colored monofilament ultrahigh molecular weight polyolefin fishing line, the method comprising the steps of:

feeding at least one substantially untwisted multifilament ultrahigh molecular weight polyolefin yarn;

coating the substantially untwisted multifilament yarn with a colorant;

twisting the coated multifilament yarn; and heating the twisted multifilament yarn to a temperature and for a time sufficient to at least partially fuse adjacent filaments together while stretching the yarn;

whereby a colored monofilament fishing line is formed having improved color-fastness and abrasion resistance.

Also in accordance with this invention, there is provided colored ultrahigh molecular weight polyolefin monofilament fishing line that has been formed by the aforementioned method.

In further accordance with this invention, there is provided a method of making colored monofilament ultrahigh molecular weight polyolefin fishing line, the method comprising the steps of:

feeding a plurality of substantially untwisted multifilament ultrahigh molecular weight polyolefin yarns;

coating the substantially untwisted multifilament yarns with a colorant;

twisting the coated multifilament yarns; and heating the twisted multifilament yarns to a temperature and for a time sufficient to at least partially fuse adjacent filaments together while stretching the yarn;

whereby a colored monofilament fishing line is formed having improved color-fastness and abrasion resistance.

Preferably, the feeder yarn is a relatively low tenacity, heavy denier yarn. Also preferably, the colorant is introduced in a carrier of a thermoplastic resin.

This invention thus provides colored fishing line from ultrahigh molecular weight polyolefins that have the feel of monofilament lines and in which the color resists abrading off and fading.

DETAILED DESCRIPTION OF THE INVENTION

The multifilament yarns used herein are formed from high tenacity polyolefin filaments. As used herein, the term "high tenacity" fibers or filaments means fibers or filaments which have tenacities equal to or greater than about 7 g/d. Preferably, these fibers have initial tensile moduli of at least about 150 g/d and energies-to-break of at least about 8 J/g as measured by ASTM D2256. As used herein, the terms "initial tensile modulus", "tensile modulus" and "modulus" mean the modulus of elasticity as measured by ASTM 2256 for a yarn.

For the purposes of the present invention, a filament is an elongate body the length dimension of which is much greater that the transverse dimensions of width and thickness. Accordingly, the term filament includes fiber, ribbon, strip, staple and other forms of chopped, cut or discontinuous fiber or continuous fiber. The term "fiber" or "filament" includes a plurality of any of the foregoing or a combination thereof. A yarn is a continuous strand comprised of many fibers or filaments. Preferred are continuous multifilament yarns.

Preferably, the high tenacity fibers have tenacities equal to or greater than about 10 g/d, more preferably equal to or greater than about 15 g/d, even more preferably equal to or greater than about 20 g/d, and most preferably equal to or greater than about 25 g/d.

The fibers utilized in the yarn of the fishing line construction of this invention comprise extended chain (also known as ultrahigh molecular weight or high modulus) polyolefin fibers, particularly high tenacity polyethylene fibers and polypropylene fibers, and blends thereof. The fibers may be gel-spun, solution-spun or extruded.

The cross-sections of fibers useful herein may vary widely. They may be circular, flat or oblong in cross-section. They may also be of irregular or regular multi-lobal cross-section having one or more regular or irregular lobes projecting from the linear or longitudinal axis of the fibers. It is preferred that the fibers be of substantially circular, flat or oblong cross-section, most preferably substantially circular cross-section.

U.S. Pat. No. 4,457,985 generally discusses such high molecular weight polyethylene and polypropylene fibers, and the disclosure of this patent is hereby incorporated by reference to the extent that it is not inconsistent herewith. In the case of polyethylene, suitable fibers are those of weight average molecular weight of at least about 150,000, preferably at least about one million and more preferably between about two million and about five million. Such high molecular weight polyethylene fibers may be spun in solution (see U.S. Pat. No. 4,137,394 and U.S. Pat. No. 4,356,138), or a filament spun from a solution to form a gel structure (see U.S. Pat. No. 4,413,110, German Off. No. 3,004, 699 and GB Patent 2051667), or the polyethylene fibers may be produced by a rolling and drawing process (see U.S. Pat. No. 5,702,657). As used herein, the term polyethylene means a predominantly linear polyethylene material that may contain minor amounts of chain branching or comonomers not exceeding about 5 modifying units per 100 main chain carbon atoms, and that may also contain admixed therewith not more than about 50 wt % of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, and the like which are commonly incorporated.

High tenacity polyethylene multifilament yarns are preferred, and these are available, for example, under the trademark SPECTRA® fibers and yarns from Honeywell International Inc. of Morristown, N.J., U.S.A Depending upon the formation technique, the draw ratio and temperatures, and other conditions, a variety of properties can be imparted to these precursor fibers. The tenacity of the polyethylene fibers are at least about 7 g/d, preferably at least about 15 g/d, more preferably at least about 20 to 5 g/d, still more preferably at least about 25 g/d and most preferably at least about 30 g/d. Similarly, the initial tensile modulus of the fibers, as measured by an Instron tensile testing machine, is preferably at least about 300 g/d, more preferably at least about 500 g/d, still more preferably at least about 1,000 g/d and most preferably at least about 1,200 g/d. These highest values for initial tensile modulus and tenacity are generally obtainable only by employing solution grown or gel spinning processes. Many of the filaments have melting points higher than the melting point of the polymer from which they were formed. Thus, for example, high molecular weight polyethylene of about 150,000, about one million and about two million molecular weight generally have melting points in the bulk of 138° C. The highly oriented polyethylene filaments made of these materials have melting points of from about 7° C. to about 13° C. higher. Thus, a slight increase in melting point reflects the crystalline perfection and higher crystalline orientation of the filaments as compared to the bulk polymer.

Preferably the polyethylene employed is a polyethylene having fewer than about one methyl group per thousand carbon atoms, more preferably fewer than about 0.5 methyl groups per thousand carbon atoms, and less than about 1 wt. % of other constituents.

Similarly, highly oriented high molecular weight polypropylene fibers of weight average molecular weight at least about 200,000, preferably at least about one million and more preferably at least about two million may be used. Such extended chain polypropylene may be formed into reasonably well oriented filaments by the techniques prescribed in the various references referred to above, and especially by the technique of U.S. Pat. No. 4,413,110. Since polypropylene is a much less crystalline material than polyethylene and contains pendant methyl groups, tenacity values achievable with polypropylene are generally substantially lower than the corresponding values for polyethylene. Accordingly, a suitable tenacity is preferably at least about 8 g/d, more preferably at least about 11 g/d. The initial tensile modulus for polypropylene is preferably at least about 160 g/d, more preferably at least about 200 g/d. The melting point of the polypropylene is generally raised several degrees by the orientation process, such that the polypropylene filament preferably has a main melting point of at least 168° C., more preferably at least 170° C. The particularly preferred ranges for the above described parameters can advantageously provide improved performance in the final article. Employing fibers having a weight average molecular weight of at least about 200,000 coupled with the preferred ranges for the above-described parameters (modulus and tenacity) can provide advantageously improved performance in the final article.

In the case of extended chain polyethylene fibers, preparation and drawing of gel-spun polyethylene fibers are described in various publications, including U.S. Pat. Nos. 4,413,110; 4,430,383; 4,436,689; 4,536,536; 4,545,950; 4,551,296; 4,612,148; 4,617,233; 4,663,101; 5,032,338; 5,246,657; 5,286,435; 5,342,567; 5,578,374; 5,736,244; 5,741,451; 5,958,582; 5,972,498; 6,448,359; 6,969,553 and 7,344,668, the disclosures of which are expressly incorporated herein by reference to the extent not incompatible herewith.

The fishing lines of this invention comprise the high tenacity polyolefin fibers, or consist essentially of the high tenacity polyolefin fibers, or consist of the high tenacity polyolefin fibers, and the polyolefin fibers preferably are high tenacity polyethylene fibers. The multifilament yarns may be formed by any suitable technique, including melt extrusion. The multifilament yarns are preferably aligned in a substantially uniaxial direction along the length of the line. By "substantially uniaxial direction" is meant that all or almost all (for example, at least about 95%, more preferably at least about 99%) of the yarns extend in a single direction. The multifilament feeder yarns are substantially untwisted. By "substantially untwisted" means that the yarns have zero twist or very little twist along their length (for example, no more than about 0.1 turns per inch (4 turns per meter), preferably no more than about 0.05 turns per inch (2 turns per meter) along the length of the yarn).

The yarns of the high tenacity fibers used herein may be of any suitable denier, such as, for example, about 100 to about 10,000 denier, more preferably from about 1000 to about 8,000 denier, still more preferably from about 650 to about 6000 denier, and most preferably from about 1200 to about 4800 denier.

The number of filaments forming the multifilament feeder yarns used in this invention may vary widely depending on the desired properties. For example, the number of filaments in a yarn may range from about 10 to about 3000, more preferably from about 30 to about 1500, and most preferably from about 60 to about 1200. Although not required, the number of filaments in each multifilament precursor yarn preferably is substantially the same.

Likewise, the number of multifilament yarns or tows forming the fishing line of this invention may vary widely. For example, the number of multifilament yarns may range from about 1 to about 16, more preferably from about 1 to about 8. Thus, there is at least one multifilament yarn, and preferably a plurality of the multifilament yarns that are processed in accordance with the invention.

In accordance with the method of this invention, the substantially untwisted multifilament yarn or yarns are coated with a colorant prior to twisting. Any suitable coating technique may be employed. Examples of coating apparatus that are useful in the method of this invention include, without limitation: lube rolls, kiss rolls, dip baths, spray coaters, etc. Alternatively, extrusion coaters may be employed. The colorant is preferably supplied in a carrier and may be in the form of a solution, dispersion or an emulsion using any suitable solvent, such as water or an organic solvent (such as methyl ethyl ketone, acetone, ethanol, methanol, isopropyl alcohol, cyclohexane, ethyl acetone, etc. and combinations thereof). The colorant is preferably applied as a continuous coating, although a discontinuous coating may be employed if desired.

In one preferred embodiment the yarn or yarns are dipped into a bath containing the colorant coating composition. Following coating by any technique, excess coating composition may be removed by any one or more suitable means, such as being squeezed out, blown off or drained off, or air dried or dried in a heating device.

As the colorant, any suitable coloring agent may be employed. Examples are dyes and pigments, both aqueous and organic. Non-limiting examples of such colorants are copper phthalocyanine and the like. The preferred colors are blue, green, yellow and black.

As mentioned above, the colorant is preferably carried in a carrier material. Such material is preferably a thermoplastic resin. Examples of such thermoplastic resins include, without limitation, polyolefin resins such as low density polyethylene, linear low density polyethylene, polyolefin copolymers, e.g., ethylene copolymers such as ethylene-acrylic acid copolymer, ethylene-ethyl acrylate copolymer, ethylene-vinyl acetate copolymer, and the like, and blends of one or more of the foregoing. The thermoplastic resin preferably has a lower melting point than the specific polyolefin fiber that is utilized, and is a drawable material.

The amount of the colored coating on the yarns may vary widely. For example, the coating may comprise from about 1 to about 40 percent by weight of the total weight of the yarns after drying, more preferably from about 2 to about 25 percent by weight, and most preferably from about 5 to about 15 percent by weight. Of course, the weight of the colorant in the coating material may be significantly less than the weight of the colored coating. Typically, the amount of colorant in the colored coating may range from about 0.5 to about 20 weight percent, more preferably from about 2 to about 15 weight percent, and most preferably from about 4 to about 10 weight percent.

Following drying of the coated, substantially untwisted polyolefin multifilament yarn or yarns, they are subjected to a twisting operation to provide the desired degree of twisting. Any suitable twisting device may be employed for this purpose, such as a ring twister, a direct cabler, and the like. Preferably, the yarns are imparted with a minimum twist of about 2 turns per inch (79 turns per meter). More preferably, the yarn or yarns are twisted to a relatively high degree, such as from about 3 to about 15 turns per inch (118 to 590 turns per meter), more preferably from about 4 to about 11 turns per inch (157 to 433 turns per meter), and most preferably from about 5 to about 7 turns per inch (197 to 276 turns per meter). Two or more multifilament yarn ends may be twisted together and then further processed, or each multifilament yarn end may be twisted and then two or more of the twisted yarn ends can be cabled together for further processing. For example, the yarns may be twisted first in a "z" direction a suitable number of times and then in the opposite "s" direction a desired number of times to obtain a balanced cable yarn, or vice versa.

The colored coated and twisted multifilament yarn or yarns are then subjected to a drawing step at an elevated temperature. The drawing step may be a single drawing step or multiple drawing steps. Preferably, the yarns are drawn in a hot air oven. Such ovens are known in the art, and an example of such an oven is described in U.S. Pat. No. 7,370,395, the disclosure of which is hereby incorporated by reference to the extent that it is not inconsistent herewith. Drawing of the multifilament yarn or yarns is preferably conducted within the melting point range of the polyolefin. Examples of techniques for drawing polyolefin multifilament yarns are disclosed in the aforementioned U.S. Pat. No. 6,148,597 and WO 2006/040191 A1, the disclosures of which are hereby incorporated by reference to the extent that they are not inconsistent herewith. Drawing is desirably achieved by one or more stretch rollers that desirably may be outside of the ovens, or alternatively inside or between one or more ovens. One oven or the first part of one oven may be employed to soften the filaments and another oven or another party of an oven may be employed to fuse the filaments together into a line.

Preferably, the multifilament yarn or yarns are heated to a relatively high temperature, such as from about 135 to about 160° C., more preferably from about 152 to about 157° C., and most preferably from about 153 to about 155° C. As mentioned above, during the heating step the multifilament yarns are drawn (or stretched) to a desired degree. Any desired stretch ratio may be employed, typically at least about 2, such as from about 2 to about 10, more preferably from about 3 to about 8, and most preferably from about 4 to about 6. Desirably, line tension is applied throughout the drawing step.

The yarn or yarns are heated and drawn for a desired period of time. The actual dwell time in a heating apparatus such as an oven depends on several factors, such as the temperature of the oven, the length of the oven, the type of oven (e.g., hot air circulating oven, heated bath, etc.), etc.

The conditions of heat and drawing are chosen such that the adjacent filaments of a multifilament yarn are at least partially fused together. It is believed that the outer surface temperature of the filaments are at or within the melting range of the polymer constituting the filaments such that the surfaces of the filaments begin to soften and fuse at contact points along the length of the outer surfaces of the filaments.

During the drawing step under elevated temperatures, the colored coating penetrates the polyolefin fiber and thus becomes an integral part thereof.

The heating and drawing step transforms the multifilament yarn or yarns into monofilament line, with the multifilament yarn being fused together at least to some degree. The resultant line is a monofilament or is substantially a monofilament (monofilament-like) has the feel of a monofilament fishing line. However, in contrast to braided yarns it does not unravel when cut. As used herein, the term "monofilament" means monofilament or monofilament-like. The feeder yarn is a relatively heavy denier, low tenacity yarn whereas the monofilament after drawing has a relatively low denier and high tenacity.

The resulting fishing line may be of any suitable diameter. For example, the monofilament fishing line may have a diameter of from about 0.001 mm to about 3 mm, more preferably from about 0.1 mm to about 1 mm, and most preferably from about 0.15 mm to about 0.5 mm.

Surprisingly, it has been found that when the multifilament yarn or yarns are colored prior to twisting, rather than after twisting, fishing line formed from such yarns exhibits increased color-fastness. The fishing line is resistant to fading due to exposure to sunlight (UV light) as well as due to rubbing or other abrasion action. Moreover, surprisingly the resulting fishing line exhibits improved abrasion resistance.

The following non-limiting examples are presented to provide a more complete understanding of the invention. The specific techniques, conditions, materials, proportions and reported data set forth to illustrate the principles of the invention are exemplary and should not be construed as limiting the scope of the invention.

EXAMPLES

Example 1

A fishing line is formed from multifilament extended chain polyethylene yarns. Each yarn is formed from SPECTRA® 900 fibers, available from Honeywell International Inc. The yarns have a denier of 1200, with 120 filaments in each yarn. The yarn tenacity is 30 g/d. One multifilament yarn having essentially zero twist is fed into a coating bath containing an aqueous solution of green dye pigment, based on copper phthalocyanine, dispersed in a polyethylene thermoplastic resin. The solids content of the coating solution is about 40 weight percent. The pick up weight of the coating onto the yarns is about 15 percent, based on the total weight of the multifilament yarns. The yarns are dried in a hot air oven (temperature of about 80 to about 110° C.). The yarns are then given a twist of 11 turns per inch (433 turns per meter). Tension is maintained in the process to prevent untwisting of the yarns.

The twisted yarns are fed into a heating apparatus as disclosed in the aforementioned U.S. Pat. No. 7,370,395, using a total of 6 horizontally aligned and abutting hot air circulating ovens. A first set of rolls is adjacent the inlet side of the ovens and a second set of rolls are adjacent the outlet side of the ovens. The yarns are unsupported in the ovens and are transported through the ovens in an approximate straight line. The speeds of the first and second set of rolls are selected to provide a draw ratio in the ovens of about 4.0. The oven temperature is about 155° C. The multifilament yarns are fused in the ovens, with adjacent yarns being at least partially fused together. The resulting structure is wound up on a take off roll and is in the form of a monofilament-like fishing line.

The color-fastness of the fishing line is tested by abrading it against a metal bar with hexagonal cross-section (the Hex Bar abrasion resistance test). The monofilament fishing line is tensioned with a 50 gram weight, and abraded back and forth over the hexagonal metal bar with "shoe-shining" like action for 2,500 cycles. The fishing line is then examined for retained color and residual breaking strength.

The monofilament fishing line retains its vibrant color and the coating also provides added abrasion resistance, such that the fishing line retains about 50 to 80 percent of its original breaking strength.

Example 2

Comparative

Fishing line is prepared in a manner similar to Example 1, with the colored coating being applied after the yarn has been twisted, and fused and drawn. The color fishing line is tested for color-fastness and abrasion resistance via the same Hex Bar test. After 2,500 cycles, the color coating is found to have been mostly abraded from the line. The fishing line retains only about 20 to 40 percent of its original breaking strength.

Example 3

Comparative

Fishing line is prepared in a manner similar to Example 2, with the colored coating being applied after twisting and before fusing and drawing. Results similar to Example 2 are noted.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A method of making colored monofilament ultrahigh molecular weight polyolefin fishing line, said method comprising the steps of:

feeding at least one substantially untwisted multifilament ultrahigh molecular weight polyolefin yarn;

coating said substantially untwisted multifilament yarn with a colorant;

twisting said coated multifilament yarn; and heating said twisted multifilament yarn to a temperature and for a time sufficient to at least partially fuse adjacent filaments together while stretching said yarn to a stretch ratio from about 3 to about 10; whereby a colored monofilament fishing line is formed that retains about 50 to 80 percent of its original breaking strength when tested by the Hex Bar abrasion resistance test.

2. The method of claim 1 wherein said multifilament yarn comprises high tenacity polyethylene filaments.

3. The method of claim 2 wherein said multifilament yarn has a have a denier of from about 100 to about 10,000.

4. The method of claim 1 wherein said colorant is applied as a coloring composition comprising said colorant and a thermoplastic resin carrier.

5. The method of claim 4 wherein said thermoplastic resin comprises a polyolefin resin.

6. The method of claim 5 wherein said thermoplastic resin comprises a polyolefin copolymer.

7. The method of claim 3 wherein said thermoplastic resin carrier has a lower melting point than said ultrahigh molecular weight polyolefin yarn.

8. The method of claim 4 wherein said coloring composition comprises from about 1 to about 40 percent by weight of said multifilament yarn after drying.

9. The method of claim 1 wherein said multifilament yarn prior to coating has zero twist.

10. The method of claim 1 wherein said twisting step imparts a twist of at least about 2 turns per inch (79 turns per meter) to said yarn.

11. The method of claim 1 wherein said twisted yarn is stretched to a stretch ratio of from about 3 to about 8.

12. The method of claim 1 wherein said twisted yarn is stretched to a stretch ratio of from about 4 to about 6.

13. The method of claim 1 wherein said twisted multifilament yarn is heated in a hot air oven.

14. The method of claim 13 wherein the temperature of said oven is from about 135 to about 160° C.

15. The method of claim 1 including drying said coating prior to twisting said multifilament yarn.

16. The method of claim 1 wherein said twisted coated multifilament yarn is heated to a temperature within the melting point range of said yarn.

17. The method of claim 1 wherein said colorant comprises a dye or pigment.

18. The method of claim 1 wherein said feeding step comprises feeding a plurality of said substantially untwisted multifilament ultrahigh molecular weight polyolefin yarns.

19. The method of claim 18 wherein said twisting step comprises twisting together a plurality of said substantially untwisted ultrahigh molecular weight polyolefin yarns.

20. A method of making colored monofilament ultrahigh molecular weight polyolefin fishing line, said method comprising the steps of:

feeding a plurality of substantially untwisted multifilament ultrahigh molecular weight polyolefin yarns;

coating said substantially untwisted multifilament yarns with a colorant;

twisting said coated multifilament yarns; and heating said twisted multifilament yarn to a temperature and for a time sufficient to at least partially fuse adjacent filaments together while stretching said yarn to a stretch ratio from about 3 to about 10; whereby a colored monofilament fishing line is formed that retains about 50 to 80 percent of its original breaking strength when tested by the Hex Bar abrasion resistance test.

21. A colored ultrahigh molecular weight polyolefin monofilament fishing line having improved abrasion resistance made by the method of claim 1.

* * * * *